US007921587B2

(12) United States Patent
Mayberry

(10) Patent No.: US 7,921,587 B2
(45) Date of Patent: Apr. 12, 2011

(54) AMBIDEXTROUS PUSH-BUTTON MAGAZINE RELEASE FOR SIDE-LOCKING AMMUNITION MAGAZINES

(75) Inventor: Michael T. Mayberry, Denver, CO (US)

(73) Assignee: Magpul Industries Corporation, Boulder, CO (US)

( * ) Notice: Subject to any disclaimer, the term of this patent is extended or adjusted under 35 U.S.C. 154(b) by 406 days.

(21) Appl. No.: 12/013,217

(22) Filed: Jan. 11, 2008

(65) Prior Publication Data

US 2010/0281736 A1 Nov. 11, 2010

Related U.S. Application Data

(60) Provisional application No. 60/884,615, filed on Jan. 11, 2007.

(51) Int. Cl.
*F41A 9/65* (2006.01)

(52) U.S. Cl. ..... 42/6; 42/49.01; 89/197

(58) Field of Classification Search ..... 42/49.01, 42/50, 49.1, 7; 89/33.1, 195, 197
See application file for complete search history.

(56) References Cited

U.S. PATENT DOCUMENTS

| | | | | |
|---|---|---|---|---|
| 1,069,338 A | | 8/1913 | Layman | |
| 1,368,719 A | | 2/1921 | Hammond | |
| 1,452,042 A | | 4/1923 | Hammond | |
| 3,568,348 A | | 3/1971 | Wilhelm | |
| 4,326,353 A | * | 4/1982 | Ludwig et al. | 42/7 |
| 4,429,479 A | | 2/1984 | Johnson | |
| 4,521,985 A | | 6/1985 | Smith | |
| 4,539,770 A | * | 9/1985 | Bornancini | 42/7 |
| 4,574,509 A | * | 3/1986 | Smith | 42/7 |
| 4,579,034 A | * | 4/1986 | Holloway | 89/33.1 |
| 4,615,134 A | | 10/1986 | Beretta | |
| 4,638,581 A | | 1/1987 | Moore | |
| 4,713,902 A | | 12/1987 | Wigton | |
| 4,747,224 A | * | 5/1988 | Smith | 42/7 |
| 4,759,144 A | | 7/1988 | Egan | |

(Continued)

FOREIGN PATENT DOCUMENTS

DE 3714464 11/1988

(Continued)

OTHER PUBLICATIONS

U.S. Appl. No. 29/302,198, filed Jan. 11, 2008, Fitzpatrick.

(Continued)

*Primary Examiner* — Benjamin P Lee
(74) *Attorney, Agent, or Firm* — Swanson & Bratschun, L.L.C.

(57) ABSTRACT

An ambidextrous magazine release for a firearm is provided for a firearm having a magazine well configured to operatively receive a magazine having a side-locking recess received within the well. The ambidextrous magazine release comprises a linkage moveable between an engaged position and a disengaged position having a lock pin configured to be received in a side-locking recess of a magazine operatively received in the magazine well with the linkage in the engaged position and to clear the side-locking recess with the linkage in the disengaged position. An actuator is provided on the firearm comprising a bar having a opposing push surfaces extending between a right and left side of the firearm. An interface is provided between the linkage and actuator with the interface being configured so that as either of the opposing push surfaces of the bar is pushed by a user, the linkage is moved between the engaged and the disengaged position.

18 Claims, 3 Drawing Sheets

U.S. PATENT DOCUMENTS

| | | | | | |
|---|---|---|---|---|---|
| 4,768,301 | A | * | 9/1988 | Thomas | 42/7 |
| 4,835,892 | A | | 6/1989 | Ruger | |
| 5,519,954 | A | | 5/1996 | Garrett | |
| D428,101 | S | * | 7/2000 | Rost et al. | D22/108 |
| 6,141,895 | A | * | 11/2000 | Rost et al. | 42/6 |
| 7,219,462 | B2 | * | 5/2007 | Finn | 42/49.01 |
| 7,596,900 | B2 | * | 10/2009 | Robinson et al. | 42/7 |
| 2005/0183310 | A1 | | 8/2005 | Finn | |
| 2006/0123683 | A1 | | 6/2006 | Garrett | |

FOREIGN PATENT DOCUMENTS

| | | |
|---|---|---|
| WO | WO 86/00400 | 1/1986 |
| WO | WO 91/14146 | 9/1991 |

OTHER PUBLICATIONS

HK USP Operators Manual (1993).
Springfield Armory XD Pistols Operation and Safety Manual (p. 30, Parts 21-24).

* cited by examiner

AMBIDEXTROUS PUSH-BUTTON MAGAZINE RELEASE FOR SIDE-LOCKING AMMUNITION MAGAZINES

RELATED APPLICATIONS

This application claims priority from U.S. Provisional Patent Application Ser. No. 60/884,615, filed Jan. 11, 2007, entitled "Firearm," which is hereby incorporated by reference.

TECHNICAL FIELD

The present invention is directed toward a magazine release for a firearm, and more particularly to an ambidextrous push-button magazine release for side-locking ammunition magazines.

BACKGROUND

A magazine release is a critical control that locks and releases the ammunition magazine from a firearm. Many firearms utilize a magazine that is linearly inserted into a magazine well in the firearm. For a number of reasons, including but not limited to the relatively long left and right sidewalls of the magazine, such firearms typically provide a side-locking recess on the magazine which is configured to engage with a magazine release mechanism of the firearm. This structure allows for a full, lateral push-button mechanism to lock and release magazines having a side-locking recess. For example, such a mechanism is used on the AR-15/M16 firearms and their associated M16 STANAG pattern magazine. Operating the side button slides the magazine release mechanism out of engagement with the side-locking recess in the magazine. This allows the magazine to drop free. However, standard AR-15/M16 firearms and other known firearms using magazines with side-locking recesses do not have a truly ambidextrous magazine release allowing actuation of the magazine mechanism by essentially the same user movement when the firearm is fired using either the left or right hand of a user.

Known firearms such as the Springfield XD and other newer generation pistols incorporate a magazine locking mechanism engaging a locking recess on the front of the magazine facilitating truly ambidextrous magazine release controls. Such structures greatly simplify the method of actuation. However, most existing systems, most notably the AR-15/M16 firearms cannot easily be converted to this method of operation. Literally millions of magazines having side-locking recesses for use with these firearms are in circulation and have been in use for many years. Thus, there is a significant logistical need for governments using the AR-15/M16 firearms and the associated M16 STANAG pattern magazines to retain the use of the M16 STANAG pattern magazines.

There have been attempts to provide an ambidextrous magazine release for firearms using a side-locking magazine by incorporating a lever into the magazine release. One such unit is known as the Norgon AmbiCatch™ and it is described in U.S. Pat. No. 5,519,954. The Norgon AmbiCatch™ incorporates a lever into the magazine release and thus combines a translational magazine release actuation from one side of the firearm and a rotational magazine release action from the other side of the firearm in order to release the magazine. More particularly, the right side control functions using a translational movement which is the conventional movement used with the AR-15/M16 firearm magazine release, but the left side control uses a rotational actuation of the lever that has significantly less travel and may be more prone to accidental disengagement. Furthermore, the different modes of actuation complicate user training as different magazine release techniques have to be taught to users who fire the firearms using their right hand versus those firing the firearm using their left hand. This also creates potential for confusion and loss of critical time if users have to switch firing hands in the field while accounting for a different release mechanism in critical firing situations.

A somewhat better design which more closely approaches a truly ambidextrous magazine release is described in Smith, U.S. Pat. No. 4,521,985. This catch release is intended for use with Colt® M1911 pistols. The Smith catch release solves at least some of the problems of the Norgon AmbiCatch™ structure by providing for actuation from both the left and right sides of the firearm by means of translational buttons. However, the Smith structure requires numerous parts and the different operational modes as between actuation from the left side and the right side may provide a different feel to the user. The Smith magazine release mechanism also requires a number of small, delicate parts, which may be detrimental to the durability and operation of the critical magazine release mechanism in dirty environments.

The ambidextrous push-button magazine release for side-locking ammunition magazines disclosed and claimed herein is intended for overcoming one or more of the problems discussed above.

SUMMARY OF THE EMBODIMENTS

An ambidextrous magazine release for a firearm is provided for a firearm having a magazine well configured to operatively receive a magazine having a side-locking recess. The ambidextrous magazine release comprises a linkage moveable between an engaged position and a disengaged position having a lock pin configured to be received in a side-locking recess of a magazine operatively received in the magazine well with the linkage in the engaged position and to clear the side-locking recess with the linkage in the disengaged position. An actuator is provided on the firearm comprising a bar having opposing push surfaces extending between a right and left side of the firearm. An interface is provided between the linkage and actuator with the interface being configured so that as either of the opposing push surfaces of the bar is pushed by a user, the linkage is moved between the engaged and the disengaged position.

In one embodiment, the linkage interface is configured so that as either of the opposing push surfaces is pushed by a user, the feel to the user is essentially the same. In another embodiment, biasing means are provided for biasing the linkage in the engaged position. Such an embodiment further includes the linkage interface being a recess in the bar defining a pair of converging cam surfaces and a cam rider extending from the linkage into contact with the cam surfaces, the linkage being in the engaged position with the cam rider at the convergence of the cam surfaces. In such an embodiment, the biasing means biases the cam rider into the convergence of the cam surfaces. An embodiment may include the linkage being L-shaped, with the lock pin extending inward from one leg of the L and the cam rider extending outward from the other leg of the L. In such an embodiment a pivotal connection is provided between the firearm and the L-shaped linkage at the intersection of the legs of the L. Such an embodiment may further comprise the leg of the L having the cam rider residing juxtaposed to the actuator bar with one cam surface distal of the cam rider and the other cam surface proximal of the cam rider with the cam rider at the convergence of the cam surfaces. The respective inclines of the cam surfaces may be different. In one embodiment the proximal cam surface has a steeper incline than the distal cam surface. The respective inclines may be selected to provide essentially the same feel to a user when pushing the actuator from either of the left or right side of the firearm.

The ambidextrous push-button magazine release for side-locking ammunition magazines disclose herein is truly ambidextrous since the same motion and feel is experienced by a user disengaging the magazine from either the left or right side of the firearm. Furthermore, the length of travel is similar whether actuated from the left or right side. The ambidextrous push-button magazine release for side-locking ammunition magazines includes only four simple parts and thus is inexpensive to build, easily assembled, simple to operate and not prone to interference from grit and shock when used in the field. Further advantages will be apparent from review of the Detailed Description and appended claims.

DETAILED DESCRIPTION

Figure 1:
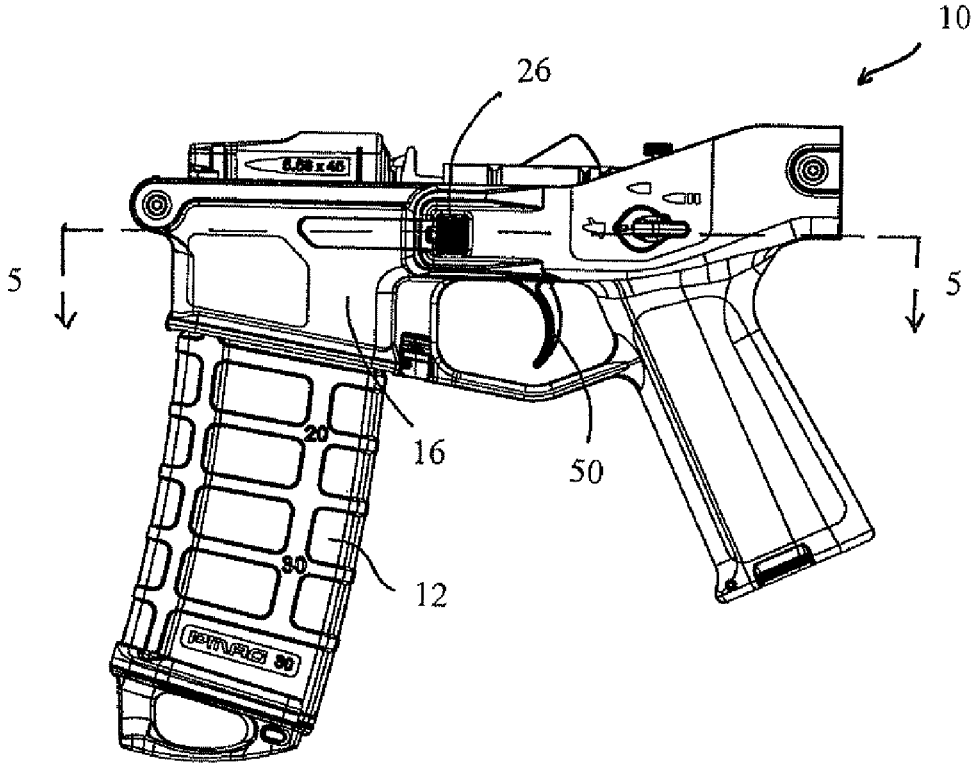
FIG. 1 is a left-side elevation view of a firearm grip housing with a linearly received side-locking ammunition magazine operatively received in a magazine well.

FIG. 1 is a side elevation view of a grip housing 10 of a firearm incorporating an ambidextrous push-button magazine release for side-locking ammunition magazines in accordance with the present invention. The grip housing 10 is one component of an assembled rifle which would also include an upper carrier housing, a barrel assembly and a stock. However, these components are not shown for the sake of clarity. Also illustrated in FIG. 1 is an ammunition magazine 12 linearly received in a magazine well 14 (see FIG. 2) of the grip housing 10. A ambidextrous magazine release mechanism 16 is viewed in part in FIG. 1 and its position relative to the trigger assembly 50 is readily apparent.

Figure 2:
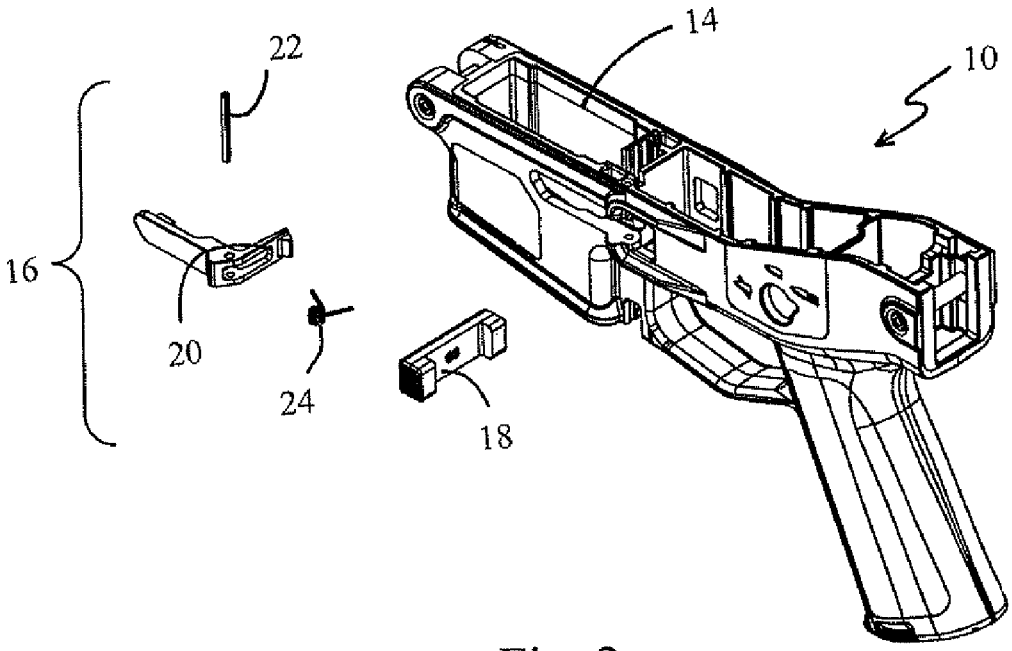
FIG. 2 is a perspective view of the grip housing of FIG. 1 with the magazine and trigger mechanism removed and the magazine release mechanism exploded therefrom.

The ambidextrous magazine release mechanism 16 is shown exploded from the grip housing 10 in FIG. 2 with the magazine and a trigger assembly removed from the grip housing. The ambidextrous magazine release mechanism 16 consists of an actuator bar 18, a linkage 20, a pivot pin 22 and a torsional spring 24.

Figure 3:
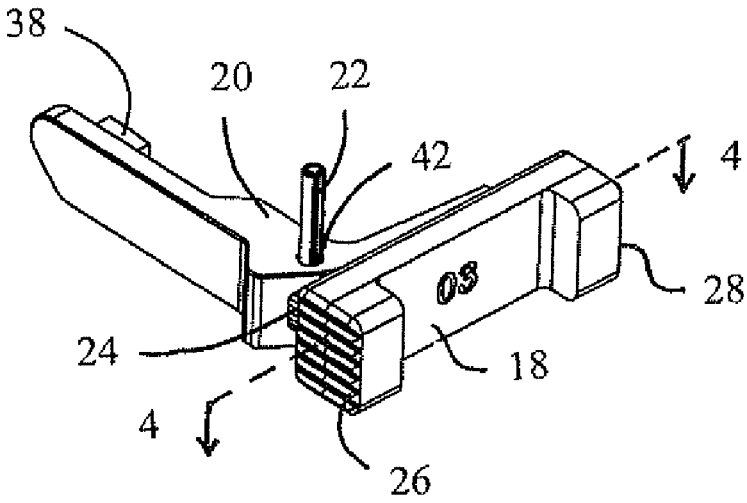
FIG. 3 is a perspective view of the assembled ambidextrous magazine release mechanism.
Figure 4:
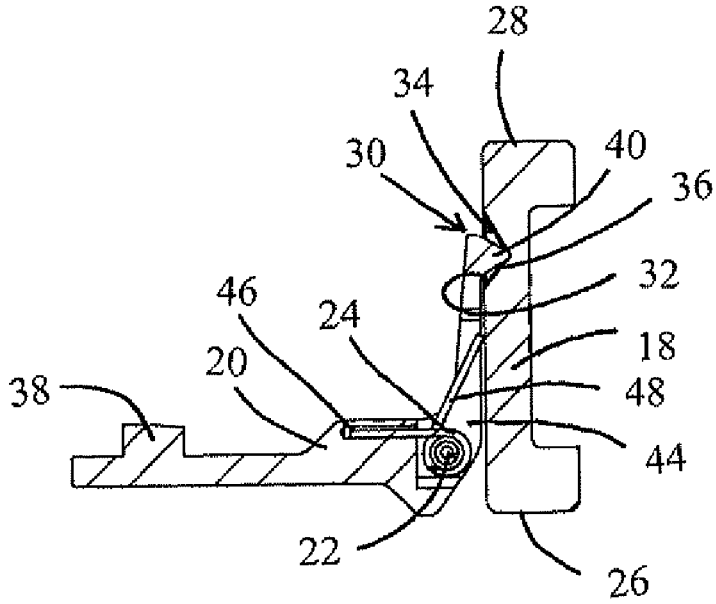
FIG. 4 is a cross-sectional view of the assembled ambidextrous magazine release mechanism of FIG. 3 taken along line 4-4 of FIG. 3.

The ambidextrous magazine release mechanism 16 is shown assembled in a perspective view in FIG. 3 and in a cross-sectional plan view in FIG. 4. With reference to FIGS. 3 and 4, the actuator bar 18 has left and right opposing push surfaces 26, 28, enlarged relative to the body of the actuator bar 18 for user comfort and accessibility. The push surfaces include texturing to minimize the risk of a users finger slipping off of the push surfaces. A recess 30 is formed in a leading surface of the actuator bar 18 near the right push surface 28. The recess 30 defines a pair of converging cam surfaces including a proximal cam surface 32 and a distal cam surface 34 meeting at a convergence 36.

The linkage 20 has an L-shaped configuration that includes an inwardly protruding lock pin 38 at a distal end of one leg of the L and an outwardly protruding cam follower 40 at the distal end of the other leg of the L. The pivot pin 22 is received in a hole 42 at the intersection of the legs of the L. The torsional spring 24 is sized to be received in a cavity 44 at the intersection of the legs of the L with the coil of the torsional spring 24 receiving the pin 22. One end of the torsional spring 24 is received in a hole 46 communicating with the cavity 44 and the other end of the torsional spring 48 abuts a portion of the grip housing 10 as viewed in FIG. 5.

Figure 5:
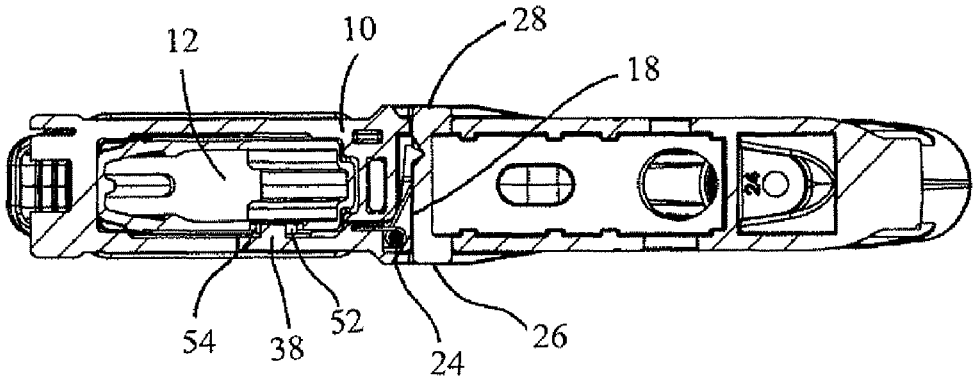
FIG. 5 is a cross-sectional view of the grip housing of FIG. 1 taken along line 5-5 of FIG. 1 with the trigger mechanism removed for clarity.
Figure 6:
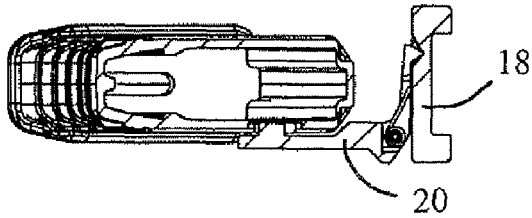
FIG. 6 is a cross-sectional view of the ambidextrous magazine release mechanism in an engaged position as viewed in FIG. 5 with a magazine having a side-locking recess.
Figure 7:
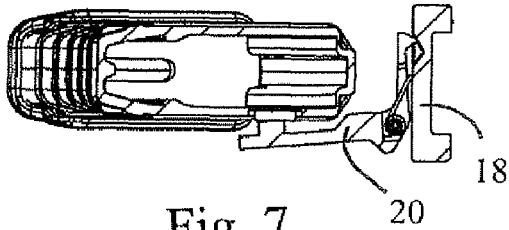
FIG. 7 is the ambidextrous magazine release mechanism of FIG. 6 in a disengaged position when pushed from the right.
Figure 8:
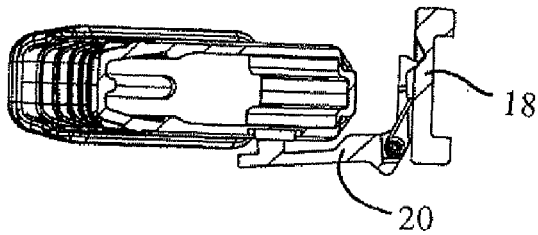
FIG. 8 illustrates the ambidextrous magazine release mechanism in a disengaged position when pushed from the left.

The ambidextrous magazine release mechanism 16 is shown installed in the grip housing 10 in FIG. 5. The actuation bar 18 is received in holes on the left and right side of the grip housing 10 in proximity to trigger 50, as best viewed in FIG. 1. The actuator bar extends between the left and right sides of the grip housing with the left and right surfaces 26, 28 readily accessible to the left and right index fingers of a user firing with his left hand or right hand, respectively. The linkage 20 is pivotally attached inside the grip housing 10 by means of the pin 22 and is positioned with the leg of L having the outwardly protruding cam follower 40 juxtaposed to the actuator bar 18 with the cam follower 40 received in the recess 30, for using an interface between the linkage and the actuator bar. The other leg of the L is dimensioned so that lock pin 38 is received in a hole 52 in the grip housing 10 which aligns with a side-locking recess 54 of an ammunition magazine 12 operatively received in the magazine well 14. As depicted in FIG. 5, the torsional spring 24 contacts an inner corner of the grip housing 10 and engages the linkage 20 to bias the lock pin 38 into engagement with the side-locking recess 54 of the ammunition magazine 12. At the same time the cam follower 40 is biased into contact with the cam surfaces of the recess 30 and rests in the convergence 36. This "engaged position" is illustrated in FIG. 6 with the grip housing and other components removed for the sake of clarity. When a user pushes the actuator bar 18 from the right, the cam follower 40 rides the distal cam surface 34, pivoting the linkage 20 to bring the lock pin 38 out of engagement with the side-lock recess 54. This is illustrated in FIG. 7. FIG. 8 illustrates the lock pin 38 disengaged from the side-locking recess 54 when the actuator bar 18 is pushed from the left.

Referring to FIG. 4, it can be observed that the distal cam surface 34 does not have as steep an incline as the proximal cam surface 32. These inclines are selected so that the "feel" to a user when pushing the actuator bar 18 to the left or to the right is essentially the same. As used herein, "feel" means the type of motion and amount of force applied to the actuator. Different inclines are required to provide essentially the same feel because when the actuator bar 18 is pushed to the left the cam follower 40 is essentially "pulled" up the proximal cam surface 32. This action requires relatively less force than required when the cam follower 40 is "pushed" up the distal cam surface 34 when the actuator bar 18 is pushed from the right. By providing a lesser incline on the distal cam surface the relative force can be substantially equalized to provide essentially the same feel with respect to the amount of force required in actuating the ambidextrous magazine release mechanism from either the right or the left. Obviously, in this design the amount of travel necessary to disengage the magazine pushing from the right is slightly greater than pushing from the left, but this difference does not interfere with the ambidextrous use of the ambidextrous magazine release mechanism because the motions and feel are otherwise identical.

While the invention has been particularly shown and described with reference to a number of embodiments, it would be understood by those skilled in the art that changes in the form and details may be made to the various embodiments disclosed herein without departing from the spirit and scope of the invention and that the various embodiments disclosed herein are not intended to act as limitations on the scope of the claims. All references cited herein are incorporated in their entirety by reference.

What is claimed is:

1. An ambidextrous magazine release for a firearm, the firearm having a magazine well configured to operatively receive a magazine, the magazine having a side locking recess within the magazine well when operatively received therein, the ambidextrous magazine release comprising:

a linkage movable between an engaged position and a disengaged position having a lock pin configured to be received in a side-locking recess of a magazine operatively received in the magazine well with the linkage in the engaged position and to clear the side-locking recess with the linkage in the disengaged position;

a one piece actuator on the firearm, the actuator comprising a bar having opposing push surfaces extending between a right and a left side of the firearm; and an interface between the linkage and the actuator, the interface being configured so that as the either of the opposing push surfaces of the bar is pushed by a user, the linkage is moved between the engaged and the disengaged position;

wherein the linkage interface comprises a recess in the bar defining a pair of converging cam surfaces and a cam rider extending from the linkage into contact with the cam surfaces, the linkage being in the engaged position with the cam rider at the convergence of the cam surfaces.

2. The ambidextrous magazine release of claim 1 further comprising means biasing the linkage in the engaged position.

3. The ambidextrous magazine release of claim 1 further comprising the linkage interface being configured so that as either of the opposing push surfaces is pushed by a user, the type of motion and amount of force applied to the actuator by a user is essentially the same.

4. The ambidextrous magazine release of claim 1 further comprising the biasing means biasing the cam rider into the convergence of the cam surfaces.

5. The ambidextrous magazine release of claim 4 wherein the biasing means comprises a torsional spring operatively associated with the linkage.

6. The ambidextrous magazine release of claim 1 wherein the linkage is L-shaped, the lock pin extending inward from one leg of the L and the cam rider extending outward from the other leg of the L.

7. The ambidextrous magazine release of claim 6 further comprising a pivotal connection between the firearm and the L-shaped linkage at the intersection of the legs of the L.

8. The ambidextrous magazine release of claim 7 further comprising the leg of the L having a cam rider residing juxtaposed to the bar with one cam surface distal of the cam rider and the other cam surface proximal of the cam rider with the cam rider at the convergence of the cam surfaces, the incline of the cam surfaces being different.

9. The ambidextrous magazine release of claim 8 wherein the proximal cam surface has a steeper incline than the distal cam surface.

10. The ambidextrous magazine release of claim 9 wherein the inclines of the proximal and distal cam surfaces are selected to provide essentially the same type of motion and amount of force when actuated from either of the left and right sides.

11. A firearm for use with a magazine having a side-locking recess, the firearm comprising:

a body having a magazine well configured to operatively receive a magazine, having a side-locking recess with the side-locking recess within the magazine well with the magazine operatively received therein; and an ambidextrous magazine release comprising: a linkage movable between an engaged position and a disengaged position having a lock pin configured to be received in a side-locking recess of a magazine operatively received in the magazine well with the linkage in the engaged position and to clear the side-locking recess with the linkage in the disengaged position;

a one-piece actuator on the firearm, the actuator comprising a bar having opposing push surfaces extending between a right and a left side of the firearm; and an interface between the linkage and the actuator, the interface being configured so that as the either of the opposing push surfaces of the bar is pushed by a user, the linkage is moved between the engaged and the disengaged position;

wherein the linkage interface comprises a recess in the bar defining a pair of converging cam surfaces and a cam rider extending from the linkage into contact with the cam surfaces, the linkage being in the engaged position with the cam rider at the convergence of the cam surfaces.

12. The firearm of claim 11 further comprising means biasing the linkage in the engaged position.

13. The firearm of claim 11 further comprising the linkage interface being configured so that as either of the opposing push surfaces is pushed by a user, the type of motion and amount of force applied to the actuator by a user is essentially the same.

14. The firearm of claim 11 further comprising the biasing means biasing the cam rider into the convergence of the cam surfaces.

15. The firearm of claim 11 wherein the linkage is L-shaped, the lock pin extending inward from one leg of the L and the cam rider extending outward from the other leg of the L.

16. The firearm of claim 15 further comprising a pivotal connection between the firearm and the L-shaped linkage at the intersection of the legs of the L.

17. The firearm of claim 16 further comprising the leg of the L having a cam rider residing juxtaposed to the bar with one cam surface distal of the cam rider and the other cam surface proximal of the cam rider with the cam rider at the convergence of the cam surfaces, the incline of the cam surfaces being different.

18. The firearm of claim 17 wherein the proximal cam surface has a steeper incline than the distal cam surface to provide essentially the same type of motion and amount of force when either actuator push surface is used to move the linkage to the disengaged position.

* * * * *